US008316466B2

(12) United States Patent
Saito

(10) Patent No.: US 8,316,466 B2
(45) Date of Patent: Nov. 27, 2012

(54) SECURE AND ABSORBENT ELONGATED HOOD

(76) Inventor: Cynthia Saito, Corona Del Mar, CA (US)

( * ) Notice: Subject to any disclaimer, the term of this patent is extended or adjusted under 35 U.S.C. 154(b) by 123 days.

(21) Appl. No.: 12/788,435

(22) Filed: May 27, 2010

(65) Prior Publication Data

US 2010/0299807 A1 Dec. 2, 2010

Related U.S. Application Data

(60) Provisional application No. 61/182,733, filed on May 31, 2009.

(51) Int. Cl.

| | |
|---|---|
| ***A42B 1/02*** | (2006.01) |
| ***A42B 1/12*** | (2006.01) |
| *A42B 1/00* | (2006.01) |

(52) U.S. Cl. ..... 2/204; 2/68; 2/202; 2/207

(58) Field of Classification Search ..... None
See application file for complete search history.

(56) References Cited

U.S. PATENT DOCUMENTS

| | | | | | |
|---|---|---|---|---|---|
| 2,431,882 | A | | 12/1947 | Morten | |
| 2,694,204 | A | | 11/1954 | Cross | |
| 3,298,035 | A | | 1/1967 | Gobins | |
| 3,714,670 | A | * | 2/1973 | Pollack et al. | 2/183 |
| 3,962,728 | A | | 6/1976 | Pavlinik | |
| 4,031,567 | A | * | 6/1977 | Planck | 2/204 |
| 4,468,818 | A | * | 9/1984 | Flannery | 2/207 |
| 4,683,596 | A | | 8/1987 | Cole | |
| 4,964,175 | A | * | 10/1990 | Taylor | 2/171 |
| 5,048,128 | A | * | 9/1991 | Watson, Jr. | 2/204 |
| 5,062,157 | A | * | 11/1991 | Muta | 2/171 |
| 5,161,260 | A | * | 11/1992 | Reynolds | 2/207 |
| 5,253,369 | A | * | 10/1993 | Patterson, Jr. | 2/207 |
| 5,365,613 | A | * | 11/1994 | Henegan | 2/174 |
| 5,490,528 | A | * | 2/1996 | Day | 132/200 |
| 5,566,689 | A | * | 10/1996 | Yeater | 132/212 |
| 5,708,982 | A | | 1/1998 | Armani | |
| 5,890,229 | A | | 4/1999 | Esposito | |
| 6,427,251 | B1 | | 8/2002 | Leach | |
| 6,735,783 | B2 | * | 5/2004 | Phillips | 2/202 |
| 7,337,475 | B1 | * | 3/2008 | Wood | 2/202 |
| 7,412,729 | B1 | | 8/2008 | McGovern | |
| 2007/0056079 | A1 | | 3/2007 | Didier | |
| 2008/0222775 | A1 | | 9/2008 | DaCruz | |

FOREIGN PATENT DOCUMENTS

| | | |
|---|---|---|
| FR | 2852506 | 9/2004 |
| GB | 2248391 | 8/1992 |

* cited by examiner

*Primary Examiner* — Bobby Muromoto, Jr.
(74) *Attorney, Agent, or Firm* — Locke Lord LLP

(57) ABSTRACT

A secure-fitting and absorbent elongated hood for containing, managing, and drying wet hair and preventing water from dripping onto flooring or onto the wearer's clothing during the hair drying or hair setting process, requiring no leaning forward of the head for application. Such elongated hood generally comprises an absorbent concave form-fitting cap having a centering button located thereon, a triangular wing of fabric extending from each of the left and right sides of said form-fitting cap of said elongated hood, reciprocal hook-and-loop fabric strips sewn onto each left and right triangular wing, an elongated tail region being progressively tapered from said concave form-fitting cap to a rounded and concave distal end and having an elastic loop for fastening purposes, and concave petal-shaped protuberances of absorbent fabric at such concave distal end for catching, retaining, and absorbing water dripping from the wearer's hair.

15 Claims, 4 Drawing Sheets

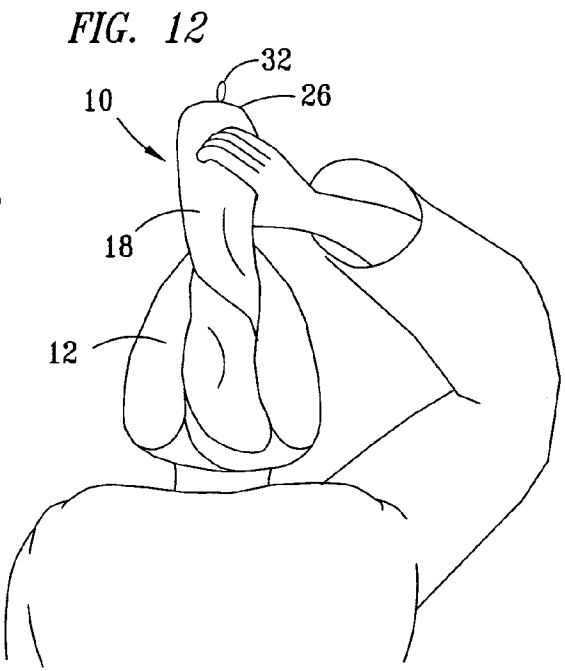
FIG. 9
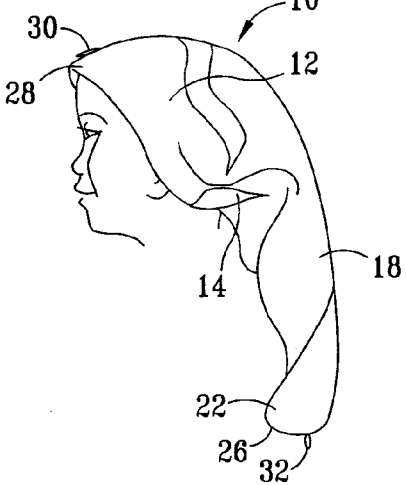
FIG. 10
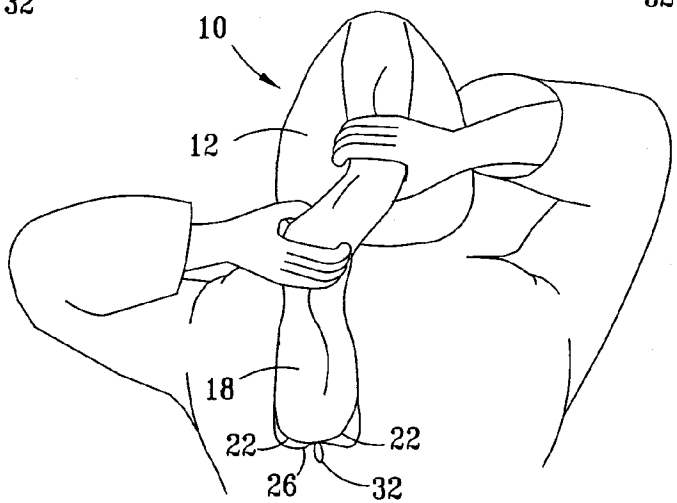
FIG. 11
FIG. 12

SECURE AND ABSORBENT ELONGATED HOOD

RELATED APPLICATIONS

This application claims the benefit of U.S. Provisional Patent Application Ser. No. 61/182,733 filed May 31, 2009, and entitled "Wrapadoo".

TECHNICAL FIELD OF THE INVENTION

The present invention relates to a secure-fitting and absorbent elongated hood for upright application onto the wearer's head, for purposes of containing, managing, and drying wet hair and preventing water from dripping onto flooring or onto the wearer's clothing during the hair drying or hair setting process.

BACKGROUND ART OF THE INVENTION

Often times, individuals exiting a shower or bath experience the inconvenience of not having a towel of the proper shape or size so as to contain and dry a substantial amount of wet hair without significant amounts of water also dripping onto the their clothing, as well as onto flooring or carpeting. In particular, problems with secure placement and fit of a large towel or conventional cloth head wrap type products upon the head of the wearer are encountered under such circumstances, given the tendency of towels or other similar cloth bath items to come loose during application, thereby essentially defeating the hair drying or hair setting purpose of the application. The inconvenience and lack of secure fit of large towels or similar bath cloth items or cloth wraps impedes the effectiveness of such products with respect to managing and drying large amounts of wet hair and, furthermore, the general unattractiveness associated with using a bath towel or similar bath cloth item to contain and dry hair decreases the desirability of utilizing such products and impedes the ability of the wearer to run errands or attend to any significant daily activities until substantial drying of the hair occurs.

While the relevant prior art indicates that various types of head covers, caps, towels, and turbans have arisen over the years to address the need for an application to contain and manage voluminous amounts of wet hair during the hair drying and hair setting process, each existing product in that regard has a number of significant disadvantages, including lack of a secure fit and awkwardness of use or application to the head, with such products being particularly limited in their capacity for preventing the falling or dripping of water onto the clothes of the user and/or onto flooring or carpeting.

In particular, it has previously been proposed in the prior art to provide a turban having a forwardly extending portion wherein the wearer is required to lean forward with their hair falling awkwardly over their forehead and face so as to place their hair in a forwardly extending portion or basket and then move or extend the filled turban backwardly onto the wearer's head so as to fasten to a rear portion of said turban. Additional prior art has previously disclosed a "head cover with pocket" which is ultimately fastened to the rear of the wearer's head by means of awkward tie straps, such head cover requiring the rather inconvenient initial step forward flip of the wearer's hair into a basket portion of the cover and a subsequent rearward pull of the basket for fastening via said tie straps at the base of the wearer's head.

As for other prior art in this technical field, a towel wrap or turban requiring forward-leaning application by the user of an open ended fabric pouch has previously been disclosed, with no secure fastening means being provided at the front of said pouch to keep the towel wrap securely in place at the front of the user's head, with the wrap also lacking an elongated span of fabric for managing long wet hair hanging down the user's back. The same can be said for other similar prior disclosures which teach the use of a towel wrap by forward leaning application onto wet hair hanging in front of the user's head and rotating the towel at the top of the user's head, with the only secure fastening means being provided by virtue of fabric ties positioned at the base of the user's head.

The existing prior art in the present technical field therefore creates a number of notable disadvantages for the wearer, including the requirement of forward application of a long portion of a turban or cap which necessitates the wearer to lean forward so as to cover the wearer's face with wet hair, thereby resulting in water dripping onto the wearer's clothing or feet, as well as onto flooring or carpeting.

The various head covering devices in the prior art also fail to provide an elongated absorbent span of fabric which can securely manage and contain wet hair running down the user's back by means of a convenient and effective fastening system, wherein such fastening system would keep the product securely in place on the user's head whether the device is folded and fastened upon the wearer's head or whether an elongated span of the device is worn straight down the back of the user so as to cover, manage, and dry long wet hair hanging vertically down the wearer's back. The head covering devices in the prior art further lack a tapered concave region at the end of an elongated portion of the device so as to catch, retain, and absorb water and prevent water from dripping down the back of the wearer onto the wearer's clothes or onto flooring or carpeting.

A need has thus arisen for an improved secure-fitting, absorbent, and water-catching/water-retaining head wrap garment or hood for convenient use by the wearer, wherein such device requires no forward leaning of the wearer for purposes of application.

SUMMARY OF THE INVENTION

In accordance with the present invention, an absorbent elongated hood for upright application onto the wearer's head for management and drying of wet hair is provided, wherein no leaning forward of the wearer's head for application is required for application of said hood. The elongated hood of the present invention includes an absorbent concave form-fitting cap for covering the wearer's head, with said cap having a centering button located at its proximal end, wherein said button appears centered directly above the wearer's forehead upon application of said cap.

The elongated hood of the present disclosure further comprises a triangular wing of fabric extending from each of the left and right sides of said concave form-fitting cap, with the positioning of each triangular wing correlating with the lower left and right sides of the form-fitting cap upon placement of said cap upon the user's head and with reciprocal hook-and-loop fabric strips, as provided under the Velcro® brand or any other suitable hook-and-loop fabric known to a person of ordinary skill in the art, sewn onto each left and right triangular wing on said hood. In one embodiment of the present invention, the reciprocal hook-and-loop fabric strips are positioned on the cap so as to have one strip sewn onto the outside of the left triangular wing, with a reciprocal strip being sewn onto the inside of the right triangular wing, such that the right triangular wing is capable of being secured over the left triangular wing behind the wearer's head and at the nape of the wearer's neck, by means of sliding or adhering one fabric strip over the other in overlapping fashion, so as to provide a means for adjusting the fit of said cap to the specific head and neck size of a particular wearer.

The hood disclosed herein further comprises an absorbent elongated tail region of fabric, said tail region being progressively tapered from said concave form-fitting cap to a rounded and concave distal end capable of hanging vertically and freely down the back of the wearer upon placement of said cap upon the wearer's head. The present invention also comprises an elastic loop centered on the concave distal end of said elongated tail region. Additionally, said rounded and concave distal end of the elongated tail region of the present invention is further comprised of a plurality of concave petal-shaped protuberances of absorbent fabric for catching, retaining, and absorbing water dripping from the wearer's hair upon placement of said elongated tail region down the wearer's back.

In one embodiment of the present disclosure, the elongated hood is made entirely from a dual layer fabric comprised of a soft velour-like polyester outer fabric shell sewn continuously along its edges with an absorbent cotton-blend inner cloth liner. In another embodiment of the invention, said outer fabric shell is made from a soft cotton or cotton-blend fabric of a type known in the art. A further embodiment of the invention provides that the inner cloth liner of said elongated hood is made from a substantially soft and absorbent microfiber fabric of the type known to a person of ordinary skill in the art. In yet another embodiment of the present invention, the elongated hood is made entirely from a single layer of absorbent soft cotton or cotton-blend cloth so as to maximize extraction of moisture or water from the wearer's hair.

In one embodiment of the present disclosure, the elongated hood is capable of being utilized by the wearer as a protective application to shield the wearer's hair from water during showering or bathing. In another embodiment of the present invention, the elongated hood is capable of being utilized by the wearer for purposes of maintaining warmth of the hair during certain therapeutic scalp treatments known in the art, as well as for purposes of preventing excess hair treatment solutions, as in the case of hair dye or other hair coloring or conditioning treatments, from dripping onto the clothes of the wearer or onto flooring or furniture. In yet another embodiment of the invention disclosed herein, the elongated hood is capable of being utilized by the wearer for purposes of concealing hair loss caused by chemotherapy or other forms of medical treatment or medication. The elongated hood is additionally capable of providing comfort, given the substantially soft feel and warmth-generating or heat-trapping character of the polyester and/or cotton surfaces of said elongated hood, to wearers undergoing chemotherapy treatment and who have developed a resulting skin hypersensitivity with respect to fluctuations in room temperature and light, as well as with respect to touch or contact.

BRIEF DESCRIPTION OF THE DRAWINGS

For a more complete understanding of the present invention and for further advantages thereof, reference is now made to the following description of the preferred embodiments taken in conjunction with the accompanying drawings in which:

FIG. 9 is a profile view showing the elongated hood of the present invention applied to the wearer's head, wherein said left and right triangular wings have been fastened behind the wearer's head at the nape of the wearer's neck and the elongated tail region is allowed to hang freely down the wearer's back, with the elongated tail region and concave distal end thereof also being depicted.

FIG. 10 is a further profile view showing the elongated hood of the present invention applied to the wearer's head, wherein said left and right triangular wings have been fastened behind the wearer's head at the nape of the wearer's neck and the elongated tail region has been twisted about its central axis and around the wearer's wet hair by the wearer as said tail region hangs down the wearer's back, with the elongated tail region and concave distal end thereof also being depicted.

FIG. 11 is a rear view of the elongated hood of said invention showing the concave form-fitting cap upon the head of the wearer and the elongated tail region of said hood being twisted about its central axis by the wearer so as wrap the wearer's wet hair therein.

FIG. 12 is a further rear view of the elongated hood of said invention showing upward vertical pulling by the wearer of the twisted elongated tail region of said hood, for purposes of ultimately securing the concave distal end of said tail region to the proximal end of the form-fitting cap of the present invention.

DETAILED DESCRIPTION OF THE INVENTION

Figure 1:
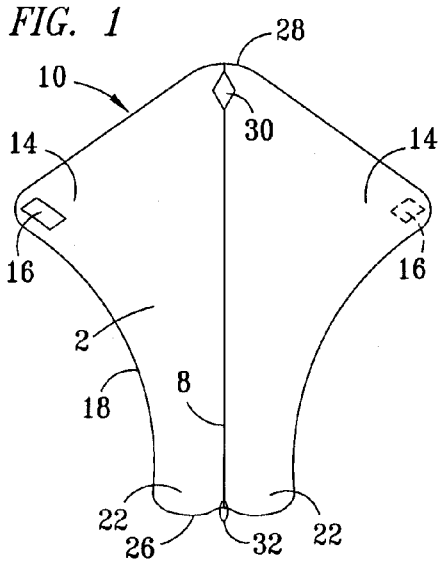
FIG. 1 is a perspective view showing the absorbent elongated hood of the present invention in open unfolded form so as to show the outer fabric shell of the hood in its entirety.
Figure 2:
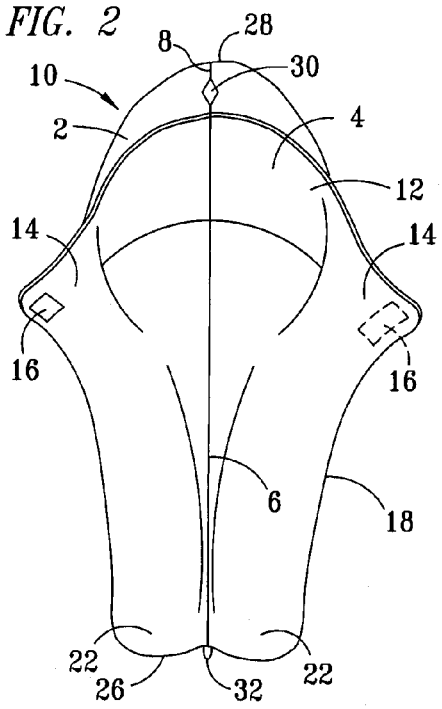
FIG. 2 is a front view of the elongated hood of the present invention primarily showing the interior of the form-fitting cap, the left and right triangular wings, and the tapered and elongated tail region of said hood.

Referring to FIGS. 1 and 2, the outer fabric shell 2 of the absorbent elongated hood 10 of the present invention is shown in open unfolded form so as to depict a triangular wing 14 extending continuously in tapered fashion from each of the respective left and right sides of the concave form-fitting cap 12 of said elongated hood 10, with reciprocal hook-and-loop fabric strips 16 being sewn onto and located near the distal tip of each triangular wing 14, and with the elongated tail region 18 of said hood 10 terminating in a concave distal end 26 comprising concave petal-shaped protuberances 22 for catching, retaining, and absorbing dripping water or moisture. At the concave distal end 26 of the elongated tail region 18, an elastic loop 32 is sewn thereon for fastening purposes, with the proximal end 28 of the form-fitting cap 12 of said hood 10 having a centering button 30 sewn thereon, for purposes of providing a centering point of reference for the wearer and for fastening purposes as well. The exterior median seam 8 of the elongated hood 10 of the present disclosure is also depicted in FIGS. 1 and 2 and in various other illustrations set forth herein. Additionally, the interior median seam 6 of the elongated hood 10 of the present disclosure is depicted in FIGS. 2 and 3.

Figure 3:
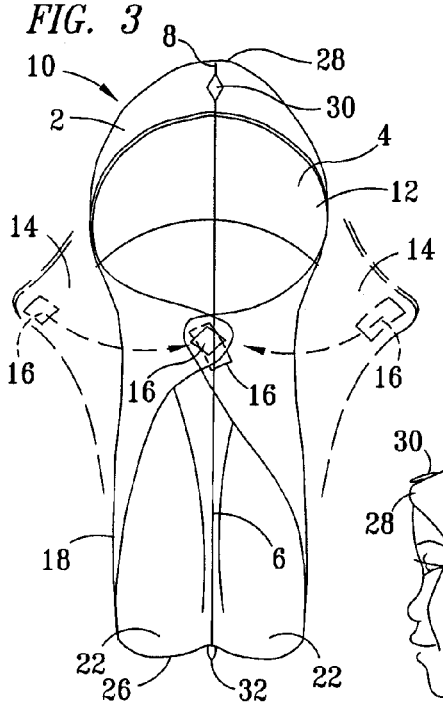
FIG. 3 is a further front view of the elongated hood of the present invention primarily showing the interior of the form-fitting cap and the manner of overlapping fastening of the left and right triangular wings by means of reciprocal hook-and-loop fabric strips sewn thereon, with the tapered and elongated tail region of said hood also being depicted.

As further shown in FIGS. 2-5, each left and right triangular wing 14 emanates in tapered fashion from the left and right sides of said form-fitting cap 12, wherein the elongated tail region 18 of said hood 10 tapers down to and terminates in a concave distal end 26 having an elastic loop 32 for fastening purposes, as further described above. FIG. 3 in particular depicts the manner in which the reciprocal hook-and-loop fabric strips 16 at each triangular wing 14 of said hood 10 are fastened to each other to facilitate secure application of said hood 10 onto the wearer's head.

In a preferred embodiment of the present disclosure, and as shown in FIGS. 2 and 3 and other illustrations set forth herein, the elongated hood 10 is made entirely from a dual layer fabric comprised of an outer fabric shell 2 made from a soft velour-like polyester or velvet-like like material of a type known in the art and sewn continuously along its edges with an absorbent cotton or cotton-blend inner cloth liner 4, in the form of terrycloth or a similar absorbent fabric known to a person of ordinary skill in the art, for purposes of maximizing extraction of moisture and water from the wearer's hair during application of said hood 10. In another embodiment of the invention, said outer fabric shell 2 is made from a soft cotton or cotton-blend fabric of a type known in the art. A further embodiment of the invention provides that the inner cloth liner 4 of said cap is made from a substantially soft and absorbent microfiber fabric of the type known to a person of ordinary skill in the art. In yet another embodiment of the present invention, the elongated hood 10 is made entirely from a single layer of absorbent cotton or cotton-blend cloth so as to maximize the capacity of the elongated hood 10 for extracting water and residual moisture from the wearer's hair.

Figure 4:
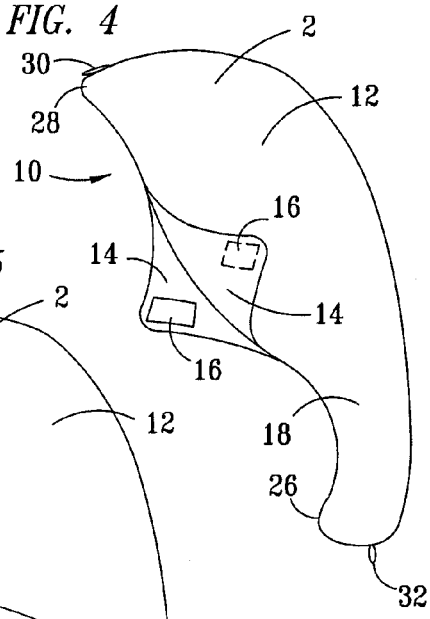
FIG. 4 is a side profile view of the elongated hood of the present invention showing the form-fitting cap and the left triangular wing folded up so as to depict the reciprocal or complementary nature and placement of the left and right triangular wings of said hood and the hook-and-loop fabric strips sewn thereon, with the elongated tail region also being depicted.
Figure 5:
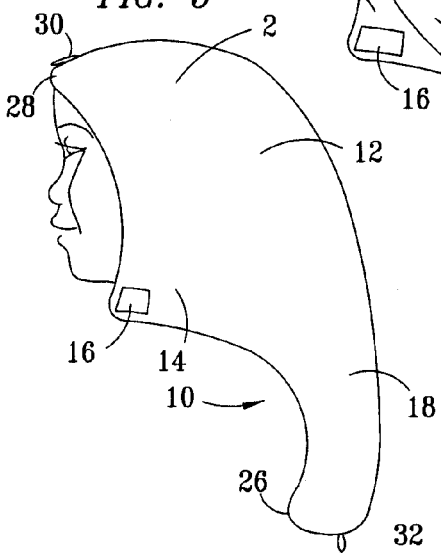
FIG. 5 is a further side profile view of the elongated hood of the present invention showing the form-fitting cap and the left triangular wing folded down, as such triangular wing appears when the unfastened hood is first placed upon the wearer's head, with the elongated tail region also being depicted.

Referring to FIGS. 2 and 3 simultaneously, the elongated hood 10 disclosed herein is comprised of a the form-fitting cap 12 wherein the triangular wing(s) 14 emanating from the left and right sides of said cap 12 are capable of being fastened in overlapping fashion at the nape of the wearer's neck by means of adhering or sliding together of the reciprocal hook-and-loop fabric strips 16 sewn thereon. Upon placement of the concave form-fitting cap 12 upon the wearer's head, the profile view of the elongated hood 10 disclosed herein would appear as shown in FIGS. 4 and 5. With respect FIG. 4, the elongated hood 10 is shown with the left triangular wing 14 of the form-fitting cap 12 folded up so as to depict the reciprocal or complementary nature and placement of each triangular wing 14 of said hood 10 and the hook-and-loop fabric strips 16 sewn thereon, with the elongated tail region 18 also being depicted. As for FIG. 5, the elongated hood 10 is shown with the left triangular wing 14 of the form-fitting cap 12 folded down, as such triangular wing 14 is generally positioned when the unfastened hood 10 is first placed upon the wearer's head, with the elongated tail region 18 being allowed to hang freely in a vertical position down the wearer's back.

Figure 6:
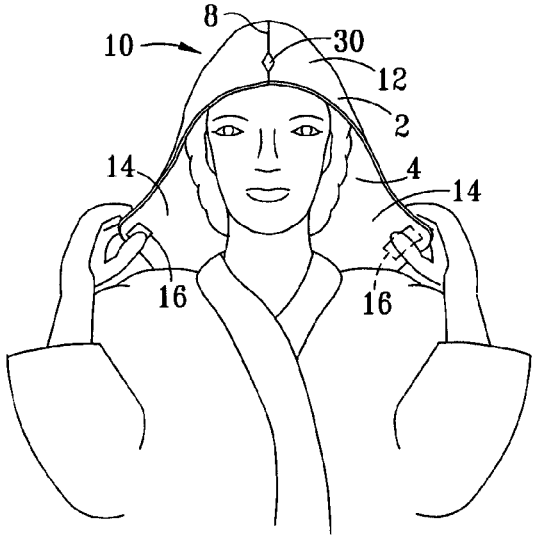
FIG. 6 is a front view of the elongated hood of said invention showing initial placement of the absorbent concave form-fitting cap upon the head of the wearer and the left and right triangular wings of said hood falling to each side of the wearer's head and being grasped by the wearer for fastening purposes.
Figure 7:
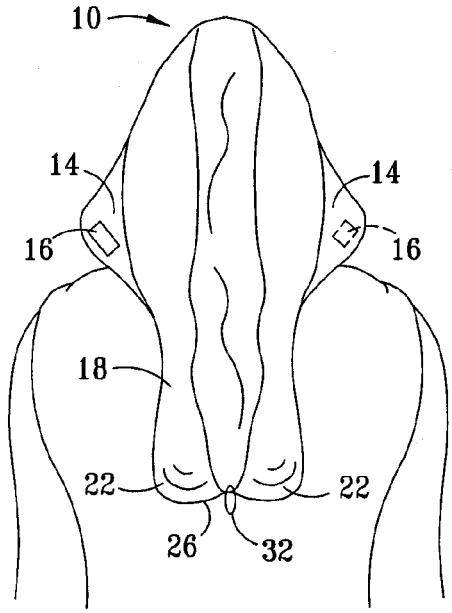
FIG. 7 is a rear view of the elongated hood of said invention showing placement of the form-fitting cap upon the head of the wearer and the elongated tail region hanging freely down the back of the wearer, with the left and right triangular wings being depicted in an unfolded and unfastened position, and with the concave petal-shaped protuberances at the concave distal end of the elongated tail region also being depicted.
Figure 8:
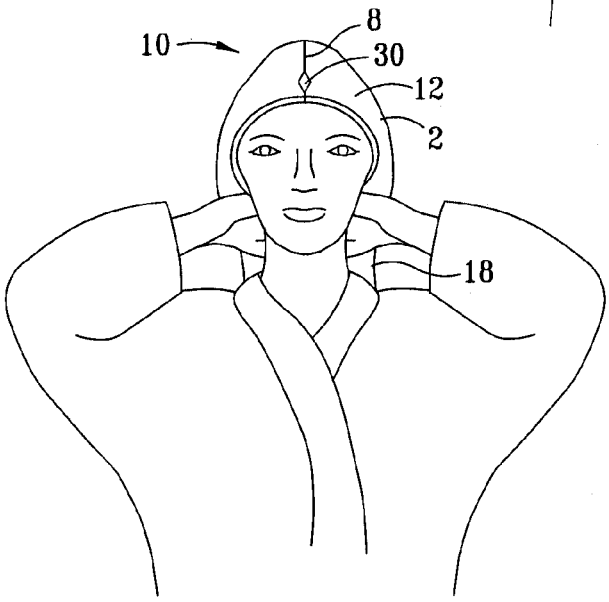
FIG. 8 is a front view of the elongated hood of the present invention showing the form-fitting cap applied to the wearer's head, with the wearer proceeding to fasten together the left and right triangular wings behind the wearer's head at the nape of the wearer's neck.

As shown in FIG. 6, the elongated hood 10 of the present invention is placed upon the wearer's head so that the triangular wing 14 on each of the left and right sides of the concave form-fitting cap 12 of said hood 10 fall alongside the wearer's face and the elongated tail region 18 of said hood 10 is allowed by the wearer to freely hang vertically and down the wearer's back as shown in FIG. 7. In this position of the elongated hood 10, each triangular wing 14 shown in FIG. 7 can then be grasped by the wearer and pulled back for fastening at the nape of the wearer's neck and behind the wearer's head as shown in FIG. 8. In a preferred embodiment of the present invention shown in FIG. 9, said elongated tail region 18 is positioned by the wearer so as to remain hanging freely down the user's back throughout the hair drying process so as to maximize the water catching and absorption utility of the concave petal-shaped protuberances 22 at the concave distal end 26 of said tail region 18, with said petal-shaped protuberances 22 being further depicted in FIG. 7.

Figure 13:
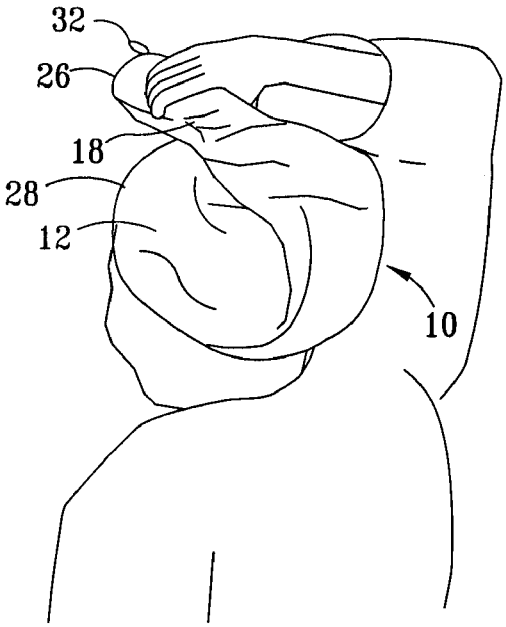
FIG. 13 is a left side and partial rear view of the present invention depicting forward pulling by the wearer of the twisted elongated tail region towards the proximal end of the form-fitting cap.
Figure 15:
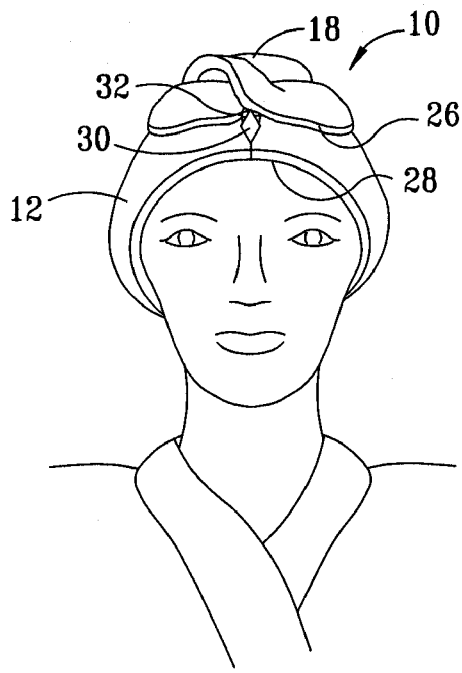
FIG. 15 is a front view of the elongated hood of the present invention depicting said hood fully applied to the wearer's head, wherein the elastic loop at the concave distal end of said tail region has been fastened to the centering button at the proximal end of said form-fitting cap.
Figure 14:
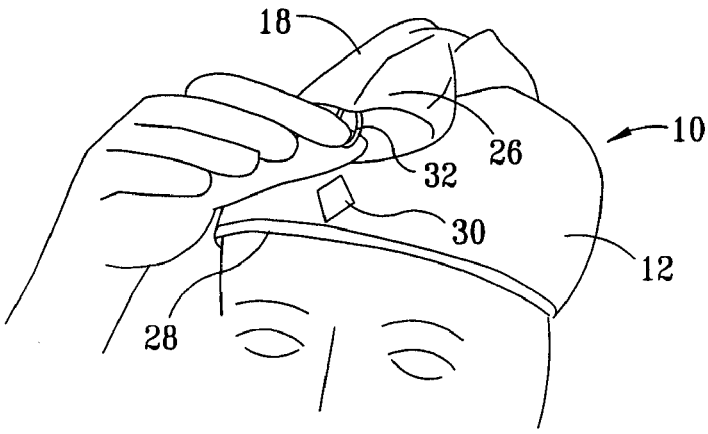
FIG. 14 is a front view of the present invention further depicting forward pulling by the wearer of the twisted tail region towards the proximal end of the form-fitting cap of the present invention and the step of fastening the elastic loop at the concave distal end of said tail region to the centering button at the proximal end of said form-fitting cap.

With reference to FIG. 15, a preferred embodiment of the present invention provides that the elongated hood 10 is capable of being worn with the concave distal end 26 of said tail region 18 securely fastened to the proximal end 28 of said concave form-fitting cap 12. Referring back to FIG. 10, once each triangular wing 14 at the left and right sides of the concave form-fitting cap 12 of said hood 10 have been fastened behind the wearer's head at the nape of the wearer's neck, a preferred embodiment of the present invention provides that the elongated tail region 18 of said hood 10 is then twisted by the wearer, as further shown in FIG. 11, about its central axis and around the wearer's wet hair once or twice by the wearer as said tail region 18 hangs vertically down the wearer's back. Referring to FIG. 12, the twisted form of the elongated tail region 18 of said elongated hood 10 of the present invention is then pulled in an upward and vertical fashion by the wearer. The twisted elongated tail region 18 is then subsequently pulled forward by the wearer towards the wearer's forehead, as shown in FIG. 13, for purposes of ultimately securing the concave distal end 26 of said tail region 18 to the proximal end 28 of said form-fitting cap 12 of the present invention as shown in FIGS. 14 and 15, by means of fastening the elastic loop 32 at the concave distal end 26 of said elongated tail region 18 around the centering button 30 located at the proximal end 28 of said concave form-fitting cap 12.

In an alternate embodiment of the invention disclosed herein and shown back in FIG. 9, said elongated hood 10 is capable of remaining securely fitted to the wearer's head even with said elongated tail region 18 positioned so as to remain freely hanging vertically down the user's back for purposes of covering, managing, and drying long wet hair. Such configuration of the elongated hood 10 is accomplished by application of the concave form-fitting cap 12 to the wearer's head and overlapping fastening together of each left and right triangular wing 14 at the nape of the wearer's neck and behind the wearer's head, as further illustrated in FIGS. 3 and 8, via reciprocal hook-and-loop fabric strips 16 sewn onto each triangular wing 14, so as to provide a secure and adjustable fit while the elongated tail 18 remains hanging down the wearer's back.

With particular reference to FIGS. 1-3 and FIGS. 4 and 5, a preferred embodiment of the present invention provides that the reciprocal hook-and-loop fabric strips 16 are positioned on the elongated hood 10 so as to have one hook-and-loop fabric strip 16 sewn onto the outside of the left triangular wing 14, with a reciprocal hook-and-loop fabric strip 14 being sewn onto the inside of the right triangular wing 14, such that the right triangular wing 14 is capable of being secured in overlapping fashion over the left triangular wing 14 at the nape of the wearer's neck.

I claim:

1. An absorbent elongated hood for upright application onto the wearer's head, requiring no leaning forward of the head for application, for management and drying of wet hair comprising:

an absorbent concave form-fitting cap for covering the wearer's head, with said cap having a centering button located at its proximal end, wherein said centering button appears centered directly above the wearer's forehead upon application of said cap;

a triangular wing of fabric extending from each of the left and right sides of said concave form-fitting cap of said elongated hood, with the positioning of each triangular wing adjacent the lower left and lower right sides of said form-fitting cap upon placement of said cap on the wearer's head;

reciprocal hook-and-loop fabric strips sewn onto each left and right triangular wing of said hood near a tip of each wing, wherein upon placement of said form-fitting cap on the wearer's head, the triangular wings are positioned to be fastened together at the tips thereof via overlapping application of said hook-and-loop fabric strips at the nape of the wearer's neck in a manner such that said triangular wings wrap around the wearer's hair and conform to the back of the wearer's head without requiring the wearer to lean forward;

an absorbent elongated tail region of fabric, said elongated tail region being progressively tapered from the tips of the triangular wings to a rounded and concave distal end, said elongated tail region configured to hang freely and vertically down the back of the wearer upon placement of said cap on the wearer's head in a manner such that said elongated tail region drapes over the wearer's hair without enclosing or containing the hair;

an elastic loop centered on said concave distal end of said elongated tail region.

2. The elongated hood of claim 1, wherein said rounded and concave distal end of the absorbent elongated tail region is comprised of two concave petal-shaped protuberances of absorbent fabric configured for catching, retaining, and absorbing water dripping from the wearer's hair upon placement of said elongated tail region so as to hang vertically and freely down the wearer's back.

3. The elongated hood of claim 2, wherein the hood is capable of being worn with the concave distal end of said elongated tail region securely fastened to the proximal end of said form-fitting cap by means twisting the elongated tail region around its central axis and around the wearer's wet hair as said tail region hangs vertically down the wearer's back, pulling the twisted tail region upwards and forward over the wearer's head, and fastening the elastic loop at the concave distal end of said tail region around the centering button at the proximal end of said cap.

4. The elongated hood of claim 2, wherein the hood is capable of remaining securely fitted to the wearer's head even when said elongated tail region is positioned so as to remain freely hanging vertically down the user's back, by means of application of the concave form-fitting cap to the wearer's head and fastening together, via overlapping application of said hook-and-loop fabric strips, of each left and right triangular wing at the nape of the wearer's neck.

5. The elongated hood of claim 2, wherein the reciprocal hook-and-loop fabric strips are positioned on the elongated hood so as to have one strip sewn onto the outside of the left triangular wing, with a reciprocal strip being sewn onto the inside of the right triangular wing, such that the right triangular wing is capable of being secured in overlapping fashion over the left triangular wing at the nape of the wearer's neck.

6. The elongated hood of claim 2, wherein the fabric of said hood is comprised of a dual layer fabric having an outer fabric shell and an absorbent inner cloth liner.

7. The elongated hood of claim 2, wherein the fabric of said hood is comprised of a single layer absorbent fabric.

8. A dual layer fabric elongated hood for upright application onto the wearer's head, requiring no leaning forward of the head for application, for management and drying of wet hair comprising:

an outer fabric shell and an absorbent inner cloth liner sewn contiguously therewith, with said outer fabric shell having an exterior median seam and said inner cloth liner having an interior median seam;

an absorbent concave form-fitting cap for covering the wearer's head, with said cap having a centering button located at its proximal end to facilitate location of the front and center of said cap by the wearer for ease of placement and fastening, wherein said centering button appears centered directly above the wearer's forehead upon application of said cap;

a triangular wing of dual layer fabric extending from each of the left and right sides of said concave form-fitting cap of said elongated hood adjacent the lower left and lower right sides of said form-fitting cap upon placement of said cap on the wearer's head;

reciprocal hook-and-loop fabric strips sewn onto each left and right triangular wing of said hood near a tip of each wing, wherein upon placement of said form-fitting cap on the wearer's head, the triangular wings are positioned to be fastened together at the tips thereof via overlapping application of said hook-and-loop fabric strips at the nape of the wearer's neck in a manner such that said triangular wings wrap around the wearer's hair and conform to the back of the wearer's head without requiring the wearer to lean forward;

an absorbent elongated tail region of dual layer fabric, said elongated tail region being progressively tapered from the tips of the triangular wings to a rounded and concave distal end, said elongated tail region configured to hang freely and vertically down the back of the wearer upon placement of said cap on the wearer's head in a manner such that said elongated tail region drapes over the wearer's hair without enclosing or containing the hair;

two concave petal-shaped protuberances of absorbent fabric at said concave distal end of said elongated tail region configured for catching, retaining, and absorbing water dripping from the wearer's hair upon placement of said elongated tail region so as to hang vertically and freely down the wearer's back; and an elastic loop centered on said concave distal end of said elongated tail region.

9. The elongated hood of claim 8, wherein the hood is capable of being worn with the concave distal end of said elongated tail region securely fastened to the proximal end of said form-fitting cap by means of twisting the elongated tail region around its central axis and around the wearer's wet hair as said tail region hangs vertically down the wearer's back, pulling the twisted tail region upwards and forward over the wearer's head, and fastening the elastic loop at the concave distal end of said tail region around the centering button at the proximal end of said cap.

10. The elongated hood of claim 8, wherein the hood is capable of remaining securely fitted to the wearer's head even when said elongated tail region is positioned so as to remain freely hanging vertically down the user's back, by means of application of the concave form-fitting cap to the wearer's head and fastening together, via overlapping application of said hook-and-loop fabric strips, of each left and right triangular wing at the nape of the wearer's neck.

11. The elongated hood of claim 8, wherein the reciprocal hook-and-loop fabric strips are positioned on the elongated hood so as to have one strip sewn onto the outside of the left triangular wing, with a reciprocal strip being sewn onto the inside of the right triangular wing, such that the right triangular wing is capable of being secured in overlapping fashion over the left triangular wing at the nape of the wearer's neck.

12. The elongated hood of claim 8, wherein the outer fabric shell is made from a soft polyester velour fabric of a type known in the art and the absorbent inner cloth liner sewn contiguously therewith is made from an absorbent cotton-blend fabric known in the art such as terrycloth.

13. The elongated hood of claim 8, wherein both the outer fabric shell and the inner cloth liner are made from a cotton or cotton-blend type fabric.

14. The elongated hood of claim 8, wherein said hood is capable of being utilized by the wearer as a protective application to shield the wearer's hair from water or moisture and to maintain dryness thereof during bathing or showering.

15. The elongated hood of claim 8, wherein said hood is capable of being utilized by the wearer as a warmth-generating or heat-trapping protective or comforting application in cases where the wearer is experiencing skin hypersensitivity to fluctuations in temperature, touch or light due to chemotherapy treatment or other medical treatments which typically result in hair loss.

* * * * *